United States Patent [19]

Mandel

[11] Patent Number: 4,900,006

[45] Date of Patent: Feb. 13, 1990

[54] TANGENTIAL APPROACH, LOW NOISE PADDLE WHEEL DRIVE

[75] Inventor: Barry P. Mandel, Fairport, N.Y.

[73] Assignee: Xerox Corporation, Stamford, Conn.

[21] Appl. No.: 280,080

[22] Filed: Dec. 5, 1988

[51] Int. Cl.[4] ..... B65H 29/40

[52] U.S. Cl. ..... 271/178; 271/120; 271/220

[58] Field of Search ..... 271/120, 95, 250, 251, 271/178, 314, 315, 207, 220, 222

[56] References Cited

U.S. PATENT DOCUMENTS 4,043,549 8/1977 Rinehart ..... 271/120
4,359,219 11/1982 Garavuso ..... 271/236
4,381,860 5/1983 Silverberg ..... 271/10
4,475,733 10/1984 Benson ..... 271/120

FOREIGN PATENT DOCUMENTS 2807276 8/1978 Fed. Rep. of Germany ..... 271/178
1136703 12/1968 United Kingdom ..... 271/178

*Primary Examiner*—Richard A. Schacher

[57] ABSTRACT

A low noise paddle wheel system includes a paddle wheel and a fork shaped deflector that forces blades on the paddle wheel to approach the impact surface of a tray over which the paddle wheel is mounted tangentially in order to reduce or diminish noise created by the blades striking either copy sheets in the tray or the copy sheet support surface of the tray.

12 Claims, 2 Drawing Sheets

TANGENTIAL APPROACH, LOW NOISE PADDLE WHEEL DRIVE

This invention is directed to positioning sheets within an output device, and more particularly, to reducing the noise produced by a paddle wheel positioning sheets within a finisher.

Present paddle wheel sheet positioners in document handlers in general and finishers in particular generate too much noise as the blades of the paddle wheel strike against the sheets on the support surface of the finisher or compiler tray and is most noticeable during copy set ejection when the paddles are running against the tray without paper under them. For example, U.S. Pat. No. 4,359,219 includes a paddle wheel having affiliated with a direction plate for modifying the motion of the paddle wheel so as to force edge registration of a document. Blades of the paddle wheel strike either a platen surface or a document on the platen surface. U.S. Pat. Nos. 4,381,860 and 4,475,733 disclose paddle wheels used in conjunction with ramps to either decrease or increase the normal force of paddle wheel blades against copy sheet surfaces.

Accordingly, a low noise paddle wheel drive system is disclosed that decreases the noise of paddle wheel paper drives by adding paddle deflectors that force the paddles to approach the impact surface tangentially and thereby reduce the noise of the paddles striking either sheets or sheet support surface without minimizing the drive effect of the paddles.

The above-mentioned features and others of the invention, together with the manner of obtaining them, will best be understood by making reference to the following specification in conjunction with the accompanying drawings, wherein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is had to the drawings.

Figure 1:
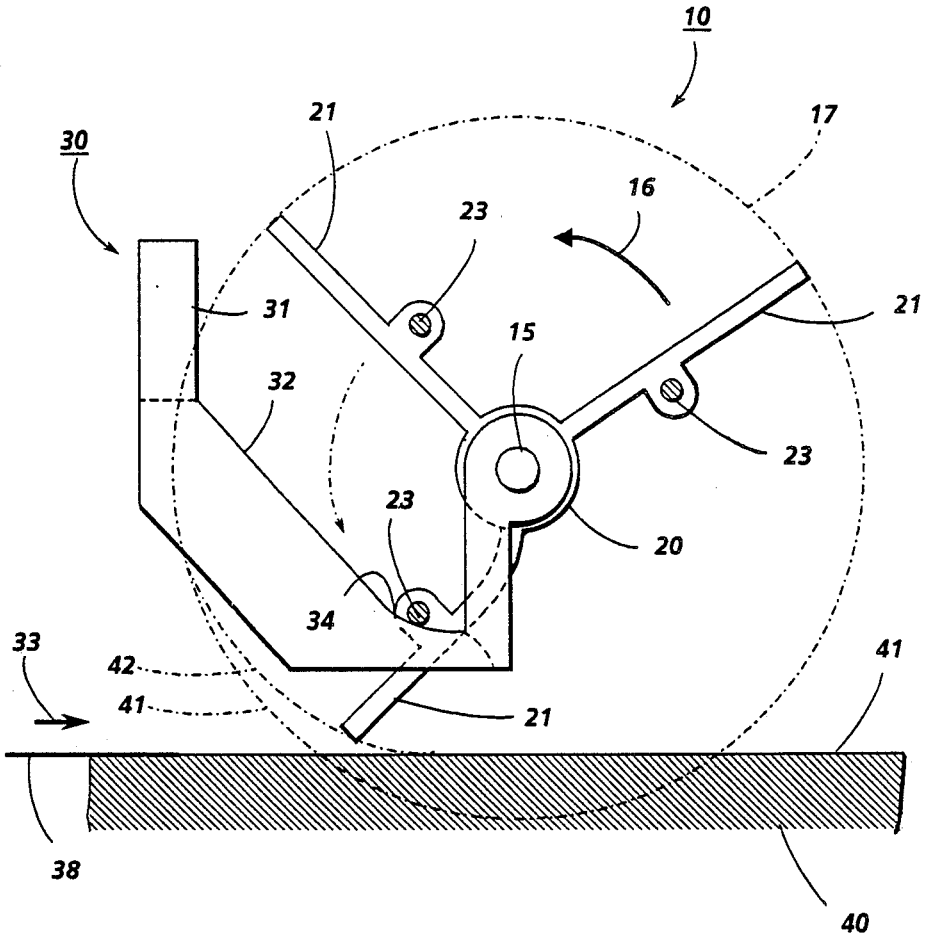
FIG. 1 is a partial schematic side view showing the paddle wheel drive system of the present invention.
Figure 2:
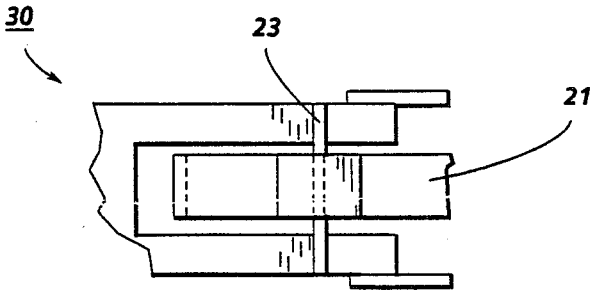
FIG. 2 is partial plan view of the paddle wheel drive system of FIG. 1.

The low noise paddle wheel system 10 of the present invention reduces or eliminates the impact of paddle wheel blades 21 of paddle wheel 20 against a compiler tray 40 or sheets 38 in the compiler tray 40 by providing a tangential approach of the paddle wheel blades 21 while not affecting the allowable penetration or normal force exerted by the blades. Copy sheets 38 are transported in the direction of arrow 33 into the compiler tray. The low noise paddle wheel system of FIGS. 1 and 2 comprise a paddle wheel 20 having blades 21 supported by a hub mounted on a support shaft 15. A deflector fork 30 is placed in front of the paddle wheel. For shaped member 30 is configured to include a series of differently inclined straight surfaces 31 and 32 and a curved surface 34. Each blade 21 has an orthogonal portion 22 protruding therefrom with a Delrin pin 23 preferably molded into it. The paddle wheel is rotated in the arc 17 in the direction of arrow 16 and the pins 23 in the paddle wheel blades contact deflector fork 30 and the blades are deflected before contacting surface 41 of compiler tray 40. Once the tips of the blades are in contact with the tray, the pins 23 leave the ends of the deflector fork allowing the blades to function in a normal manner. The deflector fork can be made of many materials, for example, stainless steel, but is preferably made of plastic and is mounted to the paddle wheel hub on shaft 15 to assist accurate positioning of the fork to the paddle wheel. Although pins 23 are shown for interacting with deflector 30 to deflect blades 21, it should be understood any device or method could be used to achieve the function as long as the blades are deflected by contacting them at approximately the middle portion of their lengths.

Fork deflector 30 has a curved portion 34 that avoids any impact on initial contact of the pins with the surface of the deflector. Ordinarily, the blades of the paddle wheel would contact surface 41 of tray 40 at such an angle that a loud noise would result from the impact of the blades with the surface of the tray. However, the addition of fork deflector 30 to interact with the blades of the paddle wheel causes the blades to strike tray surface 41 tangentially and thereby decreasing noise created by the blades striking the surface of the tray of sheets in the tray.

It should now be understood that a low noise paddle wheel drive system has been disclosed that includes a deflector fork that cooperates with blades of a paddle to thereby reduce or eliminate noise created by blades of the paddle wheel striking either sheets or the sheet support surface of a sheet holding tray. Pins are positioned in a portion of each blade of the paddle wheel that comes in contact with the fork deflector and thereby causes the blades to contact either a sheet or the surface of the tray tangentially in order to reduce or eliminate noise that would be created by the blades striking a surface in a conventional fashion.

What is claimed is:

1. A finisher apparatus, comprising:

compiling tray means:

paddle wheel means having blades thereof positioned with respect to said compiling tray means for driving sheets within said compiling tray means;

pin means positioned within each of said blades of said paddle wheel means; and deflector means positioned for riding each of said pins during a portion of rotation of said paddle wheel means such that said blades are deflected before contacting the surface of said compiling tray means, whereby noise generated by said blades of said paddle wheel contacting sheets within said compiling tray is diminished.

2. The finisher apparatus of claim 1, wherein said deflector means includes a curved surface portion that minimizes any impact of said pin means with said deflector means.

3. The finisher apparatus of claim 2, wherein said deflector means is fork shaped in order to allow said blades of said paddle wheel means to pass through said deflector means during part of the rotation of said paddle wheel means.

4. The finisher apparatus of claim 3, wherein said pin means are orthogonal with respect to the blades of said paddle wheel means.

5. A low noise paddle wheel sheet manipulating system, comprising:

a sheet support surface;

paddle wheel means positioned above said sheet support surface for manipulating sheets upon said sheet support surface, said paddle wheel means including at least one blade having a pin positioned in a portion thereof; and deflector means for deflecting said blades of said paddle wheel means by intercepting said pins in said blades of said paddle wheel means to thereby alter the angle at which said blades strike a sheet on the surface of said sheets support surface or the sheet support surface itself.

6. The low noise paddle wheel sheet manipulating system of claim 5, wherein said deflector means includes a curved surface portion that minimizes any impact of said pins with said deflector means.

7. The low noise paddle wheel sheet manipulating system of claim 6, wherein said deflector means is fork shaped in order to allow said blades of said paddle wheel means to pass through said deflector means during part of the rotation of said paddle wheel means.

8. The finisher apparatus of claim 7, wherein said pins are orthogonal with respect to the blades of said paddle wheel means.

9. A low noise sheet manipulating system, comprising:

a sheet support surface;

a paddle wheel including at least one blade and rotatably positioned above said sheet support surface;

at least one pin alters the contact angle of said blades of said paddle wheel; and a deflector that alters the contact angle of said blades of said paddle wheel with said sheet support or sheets upon said sheet support surface due to contact of said pins with said deflector.

10. The low noise sheet manipulating system of claim 9, wherein said deflector includes a curved surface portion that minimizes any impact of said at least one pin with said deflector.

11. The low noise sheet manipulating system of claim 10, wherein said deflector is fork shaped in order to allow said at least one blade of said paddle wheel to pass through said deflector during part of the rotation of said paddle wheel.

12. The finisher apparatus of claim 11, wherein said at least one pin is orthogonal with respect to said at least one blade of said paddle wheel.

* * * * *